US006572816B1

(12) United States Patent
Yang

(10) Patent No.: US 6,572,816 B1
(45) Date of Patent: Jun. 3, 2003

(54) FREE-MACHINABLE HYPER-EUTECTIC AL-SI ALLOY

(75) Inventor: Young Sek Yang, Kyunggi-do (KR)

(73) Assignee: Foosung Precision Ind., Co., Ltd., Kyunggi-Do (KR)

( * ) Notice: Subject to any disclaimer, the term of this patent is extended or adjusted under 35 U.S.C. 154(b) by 0 days.

(21) Appl. No.: 10/161,222

(22) Filed: Jun. 4, 2002

(30) Foreign Application Priority Data

Mar. 27, 2002 (KR) ..... 2002-0016721

(51) Int. Cl.[7] ..... C22C 21/02

(52) U.S. Cl. ..... 420/537; 420/538; 420/548; 420/554

(58) Field of Search ..... 420/537, 538, 420/548, 554

(56) References Cited

U.S. PATENT DOCUMENTS 5,106,436 A * 4/1992 Alabi ..... 148/438

FOREIGN PATENT DOCUMENTS

CH 665223 A5 * 4/1988 ..... C22C/21/04

* cited by examiner

*Primary Examiner*—George Wyszomierski
*Assistant Examiner*—Janelle Combs Morillo
(74) *Attorney, Agent, or Firm*—Harrison & Egbert

(57) ABSTRACT

A free-machinable hyper-eutectic Al—Si alloy includes 3.0–5.0 wt % Cu, 13–17 wt % Si, 0.2–0.5 wt % Fe, 2.5–6.0 wt % Bi, 0.005–0.02 wt % P, up to 0.1 wt % Mg, up to 0.1 wt % Ni, up to 0.5 wt% Mn and up to 0.5 wt % total sum of other elements, with the balance of the alloy being Al. The hyper-eutectic Al—Si alloy is advantageous in light of excellent machinability, easy cutting operation, extended lifetime of cutting tools and improved smoothness of cutting faces. In addition, the alloy has excellent elongation ratio and abrasion resistance, while maintaining mechanical properties such as rupture strength, tensile strength, yield strength and hardness which are similar to conventional A390 alloy, and thus can be applied to abrasion resistance-requiring applications, for example, swash plates of compressors for automotive air conditioners, without any surface treatment including anodizing or Sn plating.

1 Claim, 2 Drawing Sheets

FREE-MACHINABLE HYPER-EUTECTIC AL-SI ALLOY

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to a hyper-eutectic Al—Si alloy having excellent abrasion resistance and free machinability. In the present invention, free machinability means that machinability is excellent.

The inventive hyper-eutectic Al—Si alloy can be applied to parts requiring abrasion resistance, such as swash plates of compressors for automotive air conditioners or cylinder blocks and cylinder liners of automotive engines.

BACKGROUND OF THE INVENTION

Lubricants should be continuously fed to friction faces of swash plates of air conditioners in automobiles. Otherwise, seizure between friction metals occurs. So, metal materials having excellent abrasion resistance are suitable for use in such swash plates of compressors for automotive air conditioners.

On the other hand, in order to reduce the weight of automobiles, metals having low specific gravity are used. Also, even though metals are excellent in abrasion resistance and have low specific gravity, if they have poor workability including machinability, preparation cost becomes high. Metals, such as cast iron or bronze, have the advantage of excellent abrasion resistance and machinability but suffer from the disadvantage of high specific gravity. Therefore, in recent years, Al-based alloys have been widely used.

Typically, there is a representative hyper-eutectic Al—Si alloy having excellent abrasion resistance, lightweight property, and relatively superior workability, as shown in the following Table 1.

TABLE 1

Composition of Conventional Hyper-Eutectic Al-Si Alloy

| Composition Component | Composition Ratio (wt %) |
|---|---|
| Si | 16.0–18.0 |
| Fe | 1.3 or less |
| Cu | 4.0–5.0 |
| Mn | 0.10 or less |
| Mg | 0.45–0.65 |
| Zn | 0.10 or less |
| Ti | 0.20 or less |
| Al | Balance |

Such alloy is called A390 alloy in the related fields.

In alloys comprising two or more metals, the metals which are able to produce a congruent compound are used stoichiometrically, in which the congruent compound refers to that one metal of solid phase which is melted in the other metal of liquid phase at melted state or solid solution state.

The alloy forming the congruent compound appears to be in equilibrium state.

The alloy which consists of compositions forming the congruent compound is called a eutectic alloy, in which the eutectic alloys exist at eutectic point in equilibrium diagrams of alloys. Alloys which are positioned at the left side of eutectic point in the equilibrium diagram are referred to as hypo-eutectic alloys, and alloys located at the right side of eutectic point in the diagram are called hyper-eutectic alloys.

As for Al—Si alloy, alloys having Si of 12.5 wt % correspond to congruent compounds. Commonly, if Si content ranges from 11 to 13 wt %, such alloy is called a eutectic alloy. On the other hand, hypo-eutectic alloys have Si content less than said range and hyper-eutectic alloys have Si content higher than said range.

In the case of applying to swash plates in compressors for automotive air conditioners, conventional A390 hyper-eutectic alloys representatively used in this field are subject to surface-treatment, such as anodizing or Sn plating, to improve abrasion resistance. Such conventional alloy is disadvantageous in that, unless lubricants are smoothly fed onto friction faces, seizure between the metals occurs. As well, cutting workability becomes poor and abrasion ratio of cutting tools is very high, thus increasing preparation cost.

There is thus a widely recognized need for materials having superior machinability and abrasion resistance to conventional A390 alloy.

BRIEF SUMMARY OF THE INVENTION

It is an object of the present invention to provide a hyper-eutectic Al—Si alloy, which is excellent in free-machinability and abrasion resistance and maintains high strength through heat treatment.

The intensive and thorough research on a hyper-eutectic Al—Si alloy, carried out by the present inventors aiming to avoid the problems encountered in the prior arts, resulted in the finding that Al—Si—Cu—Bi alloy is formed under conditions of containing the minimized amounts of Mg and Ni, strongly reacting with Bi, whereby hyper-eutectic Al—Si alloys which have superior free-machinability, abrasion resistance and ductility to conventional hyper-eutectic Al—Si alloys, and maintain high strength through heat treatment, can be obtained.

As for conventional hyper-eutectic Al—Si alloys, there was no alloy containing Bi as a component.

DETAILED DESCRIPTION OF THE INVENTION

Figure 1:
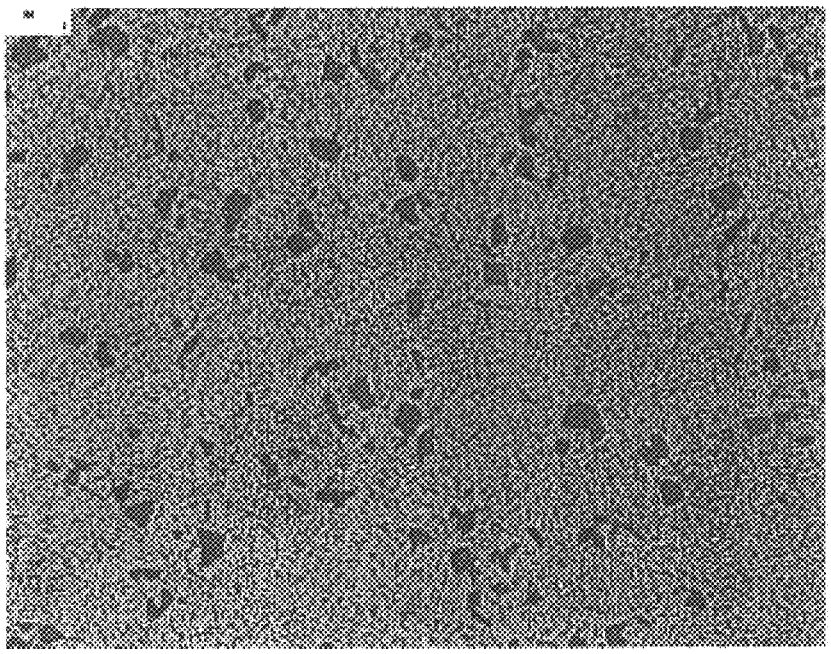
FIG. 1 is a photograph showing hyper-eutectic Al—Si alloy structure obtained from the example, taken by an optical microscope.

The present invention pertains to a hyper-eutectic Al—Si alloy, which is excellent in free-machinability and abrasion resistance due to an addition of suitable amounts of Cu, Bi, Fe and P components, and which can maintain high strength through heat treatment.

Commonly, it is known that the Bi-added Al—Si alloy has reduced intermetallic seizure.

The Bi-phase that is uniformly dispersed in the base structure allows chips obtained from the cutting process to be fined and to be discharged easily. In addition, the Bi-phase oozes out of the cutting face by the heat generated during the cutting process (this is called "bleeding"). Such phase contributes to lubrication of the cutting face and smoothing the machined face, thus improving the smoothness of the face. So, on preparation of the Al—Si alloy performing the cutting process, addition of the Bi results in resistance to seizure between the metals.

In hyper-eutectic Al—Si alloy, proeutectic Si-phase should undergo refinement. Here, refinement means that original proeutectic Si phase of a coarse and star shape is uniformly distributed to the form of a fine spherical shape in the base structure.

However, in order to perform the refinement of proeutectic Si phase in hyper-eutectic Al—Si alloy, CuP master alloy should be contained in the melt and be subject to phase transformation to AlP phase. Therefore, it is responsible for undergoing refinement of proeutectic Si. When Mg and Ni known as reinforcement elements of aluminum alloys are contained in the melt, Ni reacts with P to form NiP compound, whereby the functions of P are lowered and refinement of proeutectic Si cannot take place. In addition, formation of $Mg_3Bi_2$ compound by reaction of Mg with Bi leads to a decrease in the functions of Bi as well as lowering mechanical properties of the alloy due to reaction impurities.

The alloy has the desired physical properties when the metals contained in the composition are formed to intermetallic compounds through metallic bonding. But the Bi-phase is not formed as an intermetallic compound with Al, because it is independently distributed. So, the Bi-phase is not uniformly distributed in the Al—Si alloy structure and has a tendency to segregate and form a coarse phase. Further, the elements responsible for refinement of Si-phase are decreased in their functions and thus the Si-phase becomes coarse, lowering the ductility of Al—Si alloy. In particular, since the amount of Si which can be added is limited with decreasing of refinement of Si-phase, it is difficult to increase the abrasion resistance of the alloy. Here, coarse phase means that proeutectic Si particles are large and nonuniformly distributed.

Accordingly, in the hyper-eutectic Al—Si alloy which should have a typically high Si content, the alloy containing Bi has not yet been prepared.

As for formation of he inventive Al—Si alloy, when suitable amounts of Cu, Bi, Fe and P are added, the hyper-eutectic Al—Si alloy can be obtained, which is improved in machinability and abrasion resistance and is increased in strength through heat treatment.

P, a Group 5B element in the periodic table, does not react with its analogous element, Bi.

Component P is responsible for undergoing refinement of the proeutectic Si-phase, while not reacting with strongly reactive Bi.

The present invention is characterized in that, under the conditions of not using Sr, Ca and Na, which react strongly with Bi, and of containing minimized amounts of Mg and Ni, addition of P to the hyper-eutectic Al—Si alloy leads to refinement of proeutectic Si-phase as well as reduced segregation and coarseness of Bi-phase. Thereby, Bi to be added can be increased in the amounts and its functions can be carried out to the maximum extent.

Accordingly, the hyper-eutectic Al—Si alloy of the present invention having various functions of Bi is advantageous in terms of excellent free-machinability and abrasion resistance, compared with conventional A390 alloy. Further, the proeutectic Si-phase that undergoes refinement by P reduces a quantity of the cutting tools abraded during the cutting process. Furthermore, the Bi-phase, uniformly distributed in the base structure, allows the machined pieces obtained during the cutting process to be finely formed and to be easily discharged. In addition, Bi having low melting point oozes out of the cutting face due to heat created during the cutting process, so that lubrication in the cutting process is smoothly performed, thereby considerably increasing the smoothness of the cutting face.

In the inventive alloy, Cu in the form of $CuAl_2$ is responsible for maintaining high tensile strength of the alloy through heat treatment. Fe plays a role in decreasing $2^{nd}$ dendrite arm spacing, thus increasing the ductility of the alloy.

The alloys of the present invention can be used to swash plates of compressors for automotive air conditioners, without surface treatment such as anodizing or Sn plating required with conventional A390 alloy.

Particularly, P allows Bi-phase to uniformly distribute in Al base structure, with no reaction with Bi. Therefore, since Bi having relatively high specific gravity (9.8 g/cm$^3$) and a low melting point (271° C.) is uniformly distributed in Al base structure having relatively low specific gravity (2.7 g/cm$^3$) and a high melting point (660° C.), seizure by heterogeneous distribution and segregation of Bi phase occurring in the base structure is reduced and thus degradation of mechanical properties of the alloy can be prevented, thereby improving low ductility which is a drawback of conventional hyper-eutectic Al—Si alloys.

Also, upon friction between the metals, Bi of a low melting point is responsible for aiding lubrication of friction faces and preventing intermetallic seizure by friction heat, so increasing abrasion resistance.

A better understanding of the present invention may be obtained in light of the following example which is set forth to illustrate, but is not to be construed to limit the present invention.

EXAMPLE 41.5 kg Cu, 153 kg Si, 33 kg Fe and 35 kg Bi were weighed and introduced into a melting furnace. These metals were high purity metals suitable for use in preparation of alloys. With a view to refinement of proeutectic Si, Cu—P (8%) master alloy was added to allow the final alloy to contain 0.01 wt % P. The metal elements were molted at 700° C. for 3–4 hours, giving billets of 80 mm diameter by continuous casting. Such billets were analyzed with a spectrometer (OBLF, QSN750). As the analyzed results, the alloy obtained from the present example is composed of composition components described in the following table.

Compositions of the Al—Si alloy of the present example, and conventional A390 alloy are shown in Table 2, below.

TABLE 2

Alloy Composition (unit: wt %)

| Composition | Cu | Mg | Si | Fe | Mn | Bi | Ti | P | Al | Total |
|---|---|---|---|---|---|---|---|---|---|---|
| Alloy of Ex. | 4.15 | — | 15.30 | 0.33 | — | 3.50 | — | 0.01 | 76.71 | 100 |
| A390 | 4.00 | 0.59 | 16.20 | — | — | — | 0.043 | 0.015 | 79.15 | 100 |

The present alloy obtained from the example and conventional A390 alloy were subject to T6 heat-treatment, after which their mechanical properties were tested, and are given in Table 3, below.

TABLE 3

Mechanical Properties of Alloy

| Mechanical properties | Heat Treatment Condition | UTS (MPa) | YS (MPa) | Elongation Ratio (%) | Hardness (HB) |
|---|---|---|---|---|---|
| Alloy of Ex. | $T_6$ | 320 | 290 | 3.0 | 119 |
| A390 alloy | $T_6$ | 322 | 318 | 1.0 | 130 |

UTS: Ultimate Tensile Strength
YS: Yield Strength
MPa: Mega Pascal

Next, swash plates for automotive air conditioners, each of which was prepared by use of the Al—Si alloy of the example and A390 alloy, were tested for their rupture strength with a universal testing machine (TIRA. TT. 27100). The results are shown in the following Table 4.

TABLE 4

Rupture Strength Comparison

| | Heat treatment Condition | Maximum Load (N) |
|---|---|---|
| Alloy of Ex. | $T_6$ | 76.351 |
| A390 | $T_6$ | 76.432 |

N: Newton

<Seizure Test>

Each of the swash plates prepared by the alloy of the example (no surface treatment) and by conventional A390 alloy (Sn plating surface treatment) was mounted to compressors for air conditioners in automobiles, after which they were tested for seizure as follows.

Experimental Condition

Oil in the compressor was completely removed, and then the compressor was rotated at 1500 rpm while feeding only R134a coolant. During rotation, the time at which seizure occurred was determined.

As the results, in the swash plate which was prepared from A390 alloy and surface-treated with Sn plating, seizure occurred at 9 min. However, seizure did not occur in the inventive alloy-prepared swash plate (no surface treatment), even after 200 hrs.

FIG. 1 is an optical microscopic photograph of the hyper-eutectic Al—Si alloy structure of the example.

The black-point parts in the photograph show proeutectic Si-phase in the hyper-eutectic Al—Si alloy, in which it can be seen that crystal particles of the alloy are uniformly distributed. This means that refinement of proeutectic Si phase is almost completely performed.

Figure 2:
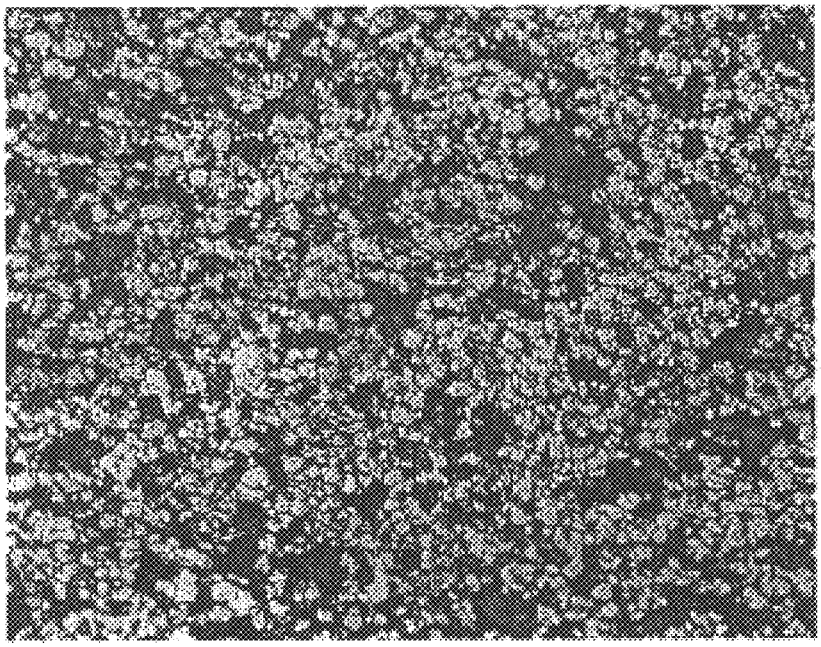
FIG. 2 is a photograph showing hyper-eutectic Al—Si alloy structure after only Bi phase is etching-removed from a hyper-eutectic Al—Si alloy obtained from the example, taken by an optical microscope.

Referring to FIG. 2, there is shown an optical microscopic photograph after Bi phase in the Al—Si alloy was etch-removed.

It appears that Bi phase uniformly distributed in the base structure is removed by etching, as can be seen in FIG. 2.

Figure 3:
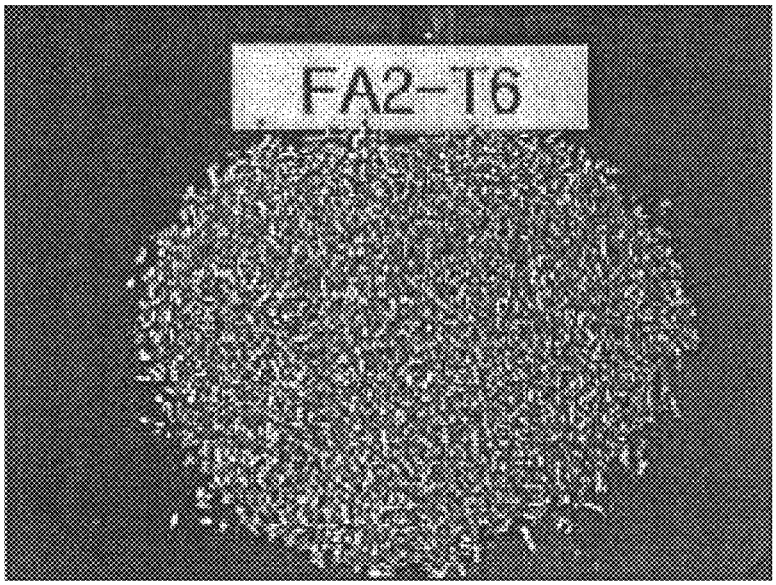
FIG. 3 is a photograph showing the state of machined pieces of the alloy in the example.

FIG. 3 illustrates the state of the machined pieces of the alloy obtained from the example.

The machined pieces were obtained when the test pieces were cut by use of a cutting tool-rotating at 500 rpm. From the figure, it can be seen that the machined pieces are fined and then discharged, in which the machined pieces have an average roughness of 1.3 mm, and smoothness of the cutting face is very excellent.

Figure 4:
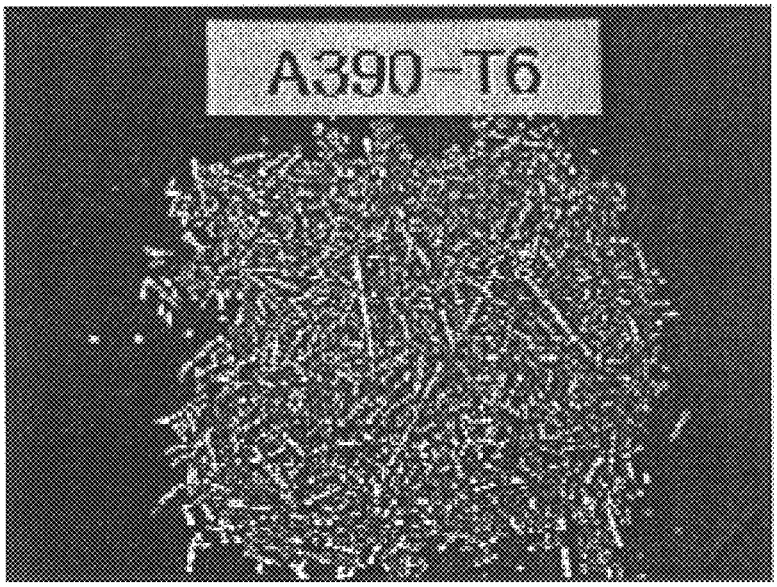
FIG. 4 is a photograph showing the state of machined pieces of A390 alloy.

FIG. 4 shows the state of the machined pieces of A390 alloy, in which test pieces are cut by use of a cutting tool rotating at 500 rpm, to yield the machined pieces.

The machined pieces were not finely formed and were present in a form of long state. They are an average of 2.3 $\mu$m in roughness.

From this test, it is apparent that smoothness of the cutting face of the conventional alloy is inferior to that of the inventive alloy.

In the present invention, alloys having various composition component ratios according to the example method were prepared, while adjusting the ratios within predetermined ranges. From this experiment, it was found that when the hyper-eutectic Al—Si alloy consists essentially of, in weight percent, 3.0–5.0 Cu, 13.0–17.0 Si, 0.2–0.5 Fe, 2.5–6.0 Bi, 0.005–0.02 P, up to 0.1 Mg, up to 0.1 Ni, up to 0.5 Mn, and up to 0.5 total sum of other elements, with the balance Al, such alloy has an excellent elongation ratio and very similar mechanical properties to the Al—Si alloy of the example.

As described above, the hyper-eutectic Al—Si alloy of the present invention has the advantages of excellent machinability, easy cutting operation, extended lifetime of cutting tools and improved smoothness of cutting faces. In addition, the inventive alloy is excellent in elongation ratio and abrasion resistance, while maintaining mechanical properties such as rupture strength, tensile strength, yield strength and hardness that are similar to conventional A390 alloy, and thus can be applied to abrasion resistance-requiring applications, for example, swash plates of compressors for air conditioners in automobiles, even though no surface treatment including anodizing or Sn plating is performed.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

I claim:

1. A free-machinable hyper-eutectic Al—Si alloy, comprising 3.0–5.0 wt % Cu, 13–17 wt % Si, 0.2–0.5 wt % Fe, 2.5–6.0 wt % Bi, 0.005–0.02 wt % P, up to 0.1 wt % Mg, up to 0.1 wt % Ni, up to 0.5 wt % Mn and up to 0.5 wt % total sum of other elements, wherein a balance of said alloy comprises Al.

* * * * *